United States Patent [19]

Schron et al.

[11] Patent Number: 4,863,205

[45] Date of Patent: Sep. 5, 1989

[54] LOAD RING ASSEMBLY

[75] Inventors: Jack H. Schron, Chagrin Falls; Lawrence H. Seidel, Mentor, both of Ohio; Charles C. DeLonghi, Barrington, Ill.

[73] Assignee: Jergens, Incorporated, Cleveland, Ohio

[21] Appl. No.: 190,503

[22] Filed: May 5, 1988

Related U.S. Application Data

[63] Continuation-in-part of Ser. No. 93,213, Sep. 4, 1987, abandoned.

[51] Int. Cl.[4] ..... B66C 1/54; B66C 1/66

[52] U.S. Cl. ..... 294/82.28; 294/89; 294/94

[58] Field of Search ..... 294/1.1, 82.1, 82.28, 294/86.25, 93, 94, 96, 89; 24/607; 248/499, 500; 279/2 R, 110, 121, 123; 403/119, 153, 164, 165; 410/85, 101, 102, 111; 411/15, 24, 33, 75, 342, 347, 348, 354, 913

[56] References Cited

U.S. PATENT DOCUMENTS

| | | | |
|---|---|---|---|
| 2,232,340 | 2/1941 | Olson | 411/348 X |
| 2,719,747 | 10/1955 | Layne | 294/89 |
| 3,297,293 | 1/1965 | Andrews et al. . | |
| 3,405,965 | 10/1968 | Haas | 294/82.28 |
| 3,680,906 | 8/1972 | Neumeier | 294/82.28 X |
| 3,933,390 | 1/1976 | Barrett et al. | 294/94 |
| 4,017,115 | 4/1977 | Holt et al. | 294/89 |
| 4,135,418 | 1/1979 | McCray et al. . | |
| 4,204,711 | 5/1980 | Lancelot et al. | 294/89 |
| 4,325,575 | 4/1982 | Holt et al. | 294/89 |
| 4,417,425 | 11/1983 | Case et al. | 294/89 X |
| 4,431,352 | 2/1984 | Andrews . | |
| 4,570,987 | 2/1986 | Wong et al. . | |

FOREIGN PATENT DOCUMENTS

| | | | |
|---|---|---|---|
| 2455958 | 1/1981 | France | 294/94 |
| 288325 | 3/1971 | U.S.S.R. | 411/348 |

*Primary Examiner*—Johnny D. Cherry

*Attorney, Agent, or Firm*—Pearne, Gordon, McCoy & Granger

[57] ABSTRACT

Load ring assemblies are disclosed which can be releasably connected to a load and provide a load ring mounted for pivotal movement so that the load ring can align itself with a connecting force applied thereto. The assembly includes a mounting member formed with a central flange intermediate its ends and cylindrical extensions extending in both directions therefrom. A pivot collar or ring is journaled on one extension for pivotal movement about the longitudinal axis of the mounting member. A U-bar or load ring is pivoted on the collar for pivotal movement about a second axis perpendicularly intersecting the first axis. Therefore, the load ring is free to pivot relative to the mounting member into alignment with a force applied thereto. The other extension is provided with a locking system having a plurality of peripherally located locking elements which are radially movable between an extended locking position and a retracted release position. In the extended position, the locking elements operate to engage a mating receptacle and lock the mounting member and the entire assembly in a load in which the receptacle is mounted. In the retracted position, the load ring assembly is freely removable from or insertable into the receptacle. The radial position of the locking elements is controlled by a threaded bolt accessible from the free end of the assembly which is operable to positively lock the locking elements in the extended and locked position and which can be retracted to allow movement of the locking elements to the retracted position.

19 Claims, 3 Drawing Sheets

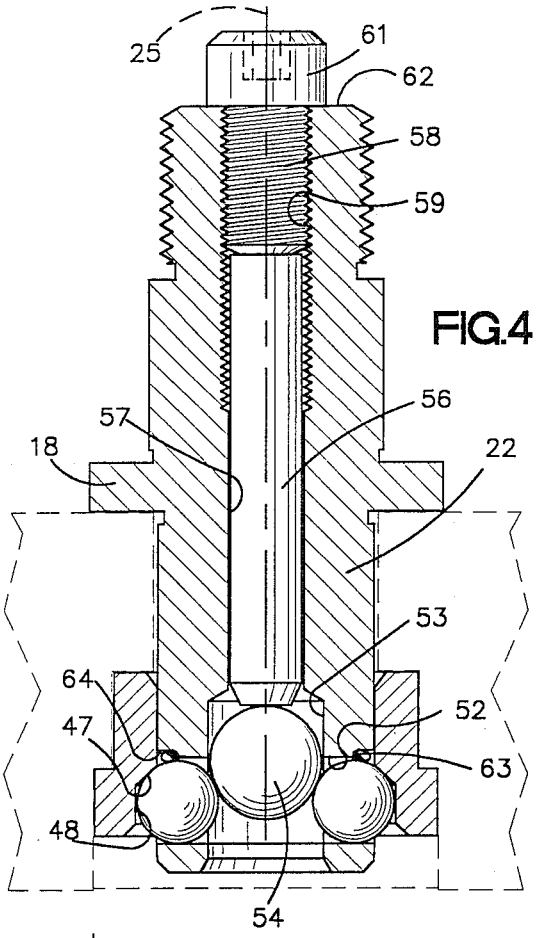
FIG.4
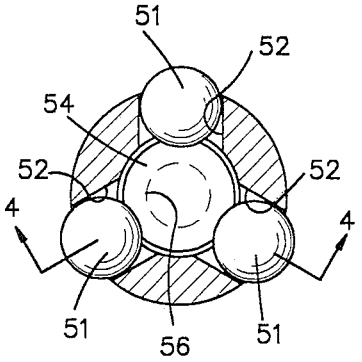
FIG.3
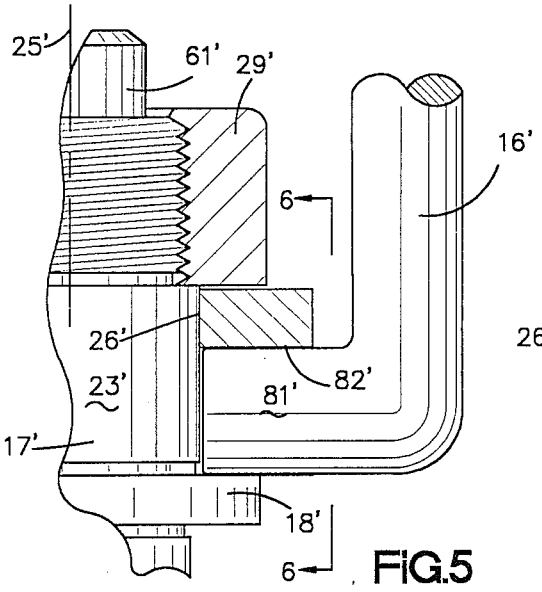
FIG.5
FIG.6
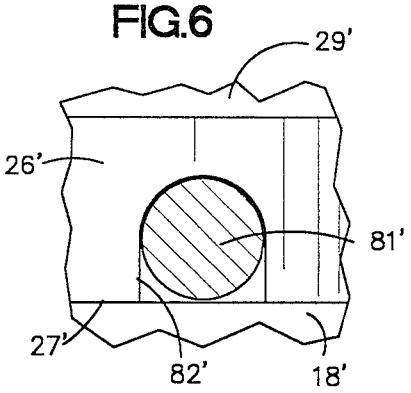

LOAD RING ASSEMBLY

BACKGROUND OF THE INVENTION

This is a continuation-in-part of copending application Ser. No. 07/093,213, filed Sept. 4, 1987, now abandoned.

This invention relates generally to load connecting devices, and more particularly to a novel and improved combination of a load ring and a releasable mounting structure for such load ring.

PRIOR ART

Load rings of various types are often anchored in or connected to a load. Such load rings may be used to secure or to tie down the connected load, or for other purposes such as providing a structure for connecting a hoist cable when lifting and transporting a load.

In many instances, the load ring is connected to a load with a swivel structure so that the ring automatically aligns itself with the direction of the connecting force. Examples of such load rings and mounting structures are illustrated in United States Letters Pat. Nos. 3,297,293; 4,431,352; and 4,570,987. Such load rings are mounted on a load by a threaded stud which is threaded into a bushing anchored in the load. The stud clamps the swivel mounting structure on the load and the swivel structure connects with the load ring itself.

In many instances, difficulties are encountered with such stud-mounted systems, since debris tends to collect in the threads in the bushings while the load ring is removed, and such debris must be cleaned out of the threads before the stud can be installed. Further, in such devices, the stud extends through a tubular bearing on which a swivel ring is mounted and the load ring is connected to the swivel ring by opposed pivots. Such structure necessarily results in a relatively small diameter mounting stud which limits, to some extent, the strength of the entire structure.

It is also known to removably mount tool holders in machine tools with a ball lock system in which a plurality of balls are moved radially into locking engagement with a cooperating annular surface to removably lock the tool holder in the machine tool. United States Letters Pat. No. 4,135,418 discloses such a structure.

SUMMARY OF THE INVENTION

The present invention provides a novel and improved load ring and mounting structure which is releasably mountable on a load. The load ring is provided with a swivel mounting so that the ring automatically aligns itself with the force applied thereto. Locking of the swivel system on the load itself is releasably provided by radially movable locking elements which are extendable to lock into a mating receptacle for locking the assembly on the load. In one illustrated embodiment, such locking elements are radially movable balls. The radial position of the balls is controlled by a threaded fastener which is accessible from the opposite end of the mounting structure and which provides positive locking of the balls in the locked position. The fastener, however, permits retraction of the balls to a released position when the assembly is to be removed from the load. The mating receptacle is a simple cylindrical bushing providing an annular, radially extending surface against which the balls lock to secure the assembly in its mounted position. Therefore, threaded connections are not required, and the problems of debris collecting within the bushing are eliminated. Further, because the load is carried directly by a mounting member, without requiring an intermediate bushing, the mounting member has substantial diameter and improved strength is provided.

In another illustrated embodiment, the locking elements are cylindrical pins having end faces shaped to provide substantial contact area. Such embodiment is preferable in applications where very high loads are encountered.

In the illustrated embodiments, the load ring assembly includes an elongated, generally cylindrical mounting member provided with a flange intermediate its ends. When the member is locked in a load, the flange engages a surface on the load and cooperates with the radially movable locking elements of the locking system to securely position the mounting member in the load. On the side of the flange opposite the load, a pivot collar is provided which is directly mounted on and is rotatable relative to the mounting member about the axis thereof. The flange cooperates with a nut threaded onto the outer end of the mounting member to axially locate the pivot collar with respect to the mounting member while permitting the swiveling movement mentioned.

A simple threaded bolt is provided which threads into the outer end of the mounting member and functions to either extend or allow retraction of the locking elements.

Spring means retain the locking elements in the mounting member when the load ring assembly is removed from the load and the bolt for extending the locking balls is sized so that the locking elements cannot be extended beyond the retaining position of such spring. It is not necessary to provide separate retaining means to retain the other various elements of the assembly together, even when the load ring assembly is removed from a load. In one embodiment, the spring is an O-ring.

In the embodiment having cylindrical locking elements, a metal spring is provided. This spring also functions to maintain the locking elements in their correct rotation orientation by preventing rotation thereof about their longitudinal axes.

A generally U-shaped load ring is pivotally mounted on the pivot collar for rotation relative thereto about an axis contained in a plane perpendicular to the first axis so that full swiveling movement is provided and the load ring itself is free to align itself with the force applied thereto. Two embodiments of load ring mounting are illustrated. In one embodiment, the pivotal mounting of the load ring itself on the pivot collar is provided by separate pivot rivets. In the other embodiment, the load ring is provided with integral pivots for increased strength.

These and other aspects of this invention are illustrated in the accompanying drawings, and are more fully described in the following specification.

BRIEF DESCRIPTION OF THE DRAWINGS

FIG. 3 is an enlarged, fragmentary view, taken generally along line 3—3 of FIG. 2, and illustrating the ball lock structure;

FIG. 4 is an enlarged, fragmentary section, taken generally along line 4—4 of FIG. 3;

FIG. 5 is an enlarged, fragmentary section, illustrating a modified form of load ring and load rng pivoting structure;

FIG. 6 is a fragmentary section, taken along line 6—6 of FIG. 5;

DETAILED DESCRIPTION OF THE DRAWINGS

Figure 1:
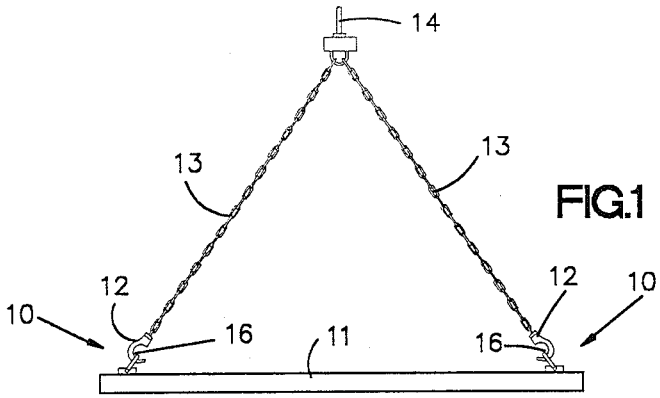
FIG. 1 illustrates a typical use for load ring assemblies in accordance with the present invention, in which load rings are mounted on a load and are connected to a lifting sling.

FIG. 1 illustrates one typical use of a load ring assembly in accordance with the present invention. In such application, a pair of load ring assemblies 10 are mounted in a beam or plate-type load 11, so that the hooks 12 of a lifting sling 13 can be connected to the load 11. The sling 13 is, in turn, connected to a lifting cable 14 of any suitable hoist (not illustrated).

Although in this instance the load ring is used for lifting a load, and is sometimes referred to as a "hoist ring," it should be understood that the load rings can be used for other purposes to provide a connection with the load. For example, the load rings mounted on one load may be lashed to load rings mounted on another load, or to a fixed anchor. Therefore, the phrases "load ring" or "load ring assembly" are not intended to be limited to a hoist ring application but are intended herein to encompass substantially any type of use for providing a releasable connection with a load of substantially any type. Because of the swivel connection provided (discussed in detail below), each load ring 16 of the two assemblies 10 aligns itself with the force applied thereto by the sling 13.

Figure 2:
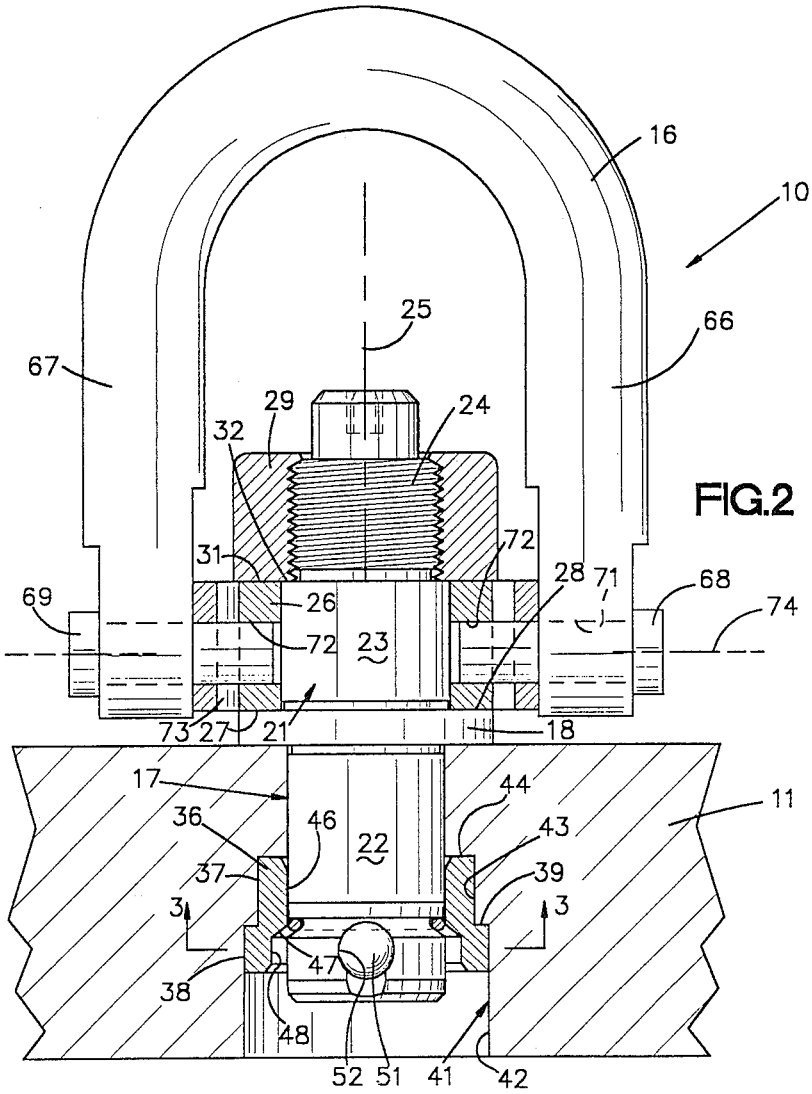
FIG. 2 is an enlarged view, partially in section, illustrating one preferred embodiment of a load ring assembly in accordance with this invention, connected to a load having a mounting bushing therein.

Referring now to FIG. 2, each load ring assembly 10 includes an elongated mounting member 17 providing a flange 18 intermediate its ends. The mounting member also provides first and second generally cylindrical extensions 21 and 22, respectively, extending in opposite directions from the flange 18.

The first extension 21 provides a cylindrical portion 23 extending from one side of the flange 18 and a threaded outer portion 24. A swivel collar 26 is journaled on the cylindrical portion 21 for rotation relative thereto about a first axis 25. This swivel collar or pivot collar 26 is provided with a lower end face 27 engageable with the upper surface 28 of the flange 18. A nut 29 is threaded onto the threaded portion 24 and is engageable with the upper face 31 of the swivel or pivot collar 26. The mounting member 17 is provided with a shoulder 32 against which the nut bears and is tightened. The shoulder 32 is spaced from the upper surface of the flange 18 by a distance slightly greater than the height of the pivot collar 26 so that when the nut is tightened into place, the pivot collar is not clamped against rotation, but is merely maintained in a fixed axial position with respect to the mounting member 17.

The other extension 22 of the mounting member 17 is also generally cylindrical, and is sized to fit into a hardened metal mounting bushing 36 mounted in the load 11. The particular mounting bushing 36 illustrated provides a stepped outer surface, including an upper cylindrical portion 37 and a lower cylindrical portion 38 joined by a radial surface 39.

The mounting bushing is press-fitted or otherwise secured in a mating stepped bore 41 provided in the load 11. The stepped bore 41 includes a first cylindrical portion 42 sized to receive the cylindrical portion 38 and a second cylindrical portion 43 sized to receive the cylindrical portion 37 of the bushing 36. The stepped bore also provides radial shoulders engageable with the mating shoulder 39 of the bushing and engageable with the upper end 44 of the bushing so that the bushing is securely mounted in a load against upward movement. It should be understood that other forms of mounting a bushing within a load may be used, but that the bushing mounting structure illustrated in FIG. 2 is given as one example of one bushing structure which may be utilized in accordance with the invention.

The bushing 36 also provides an upper bore 46 sized to receive the second extension 22 of the mounting member with a close fit and a conical wall 47 extending from the bore 46 to a larger diameter bore 48. The bushing 36 and the stepped bore 41 are preferably open at both ends so that debris will not collect.

A plurality of radially movable locking elements 51, hardened metal balls in this illustrated embodiment, are positioned in radially extending passages 52 and are movable between a retracted position for release of the load ring assembly and an extended position in which they engage the conical wall 47 to lock the load ring assembly in the load 11. In such extended position, the balls clamp the adjacent surface of the shoulder against the surface of the load.

Reference should now be made to FIGS. 3 and 4, which best illustrate the structural arrangement of the ball locking system. In this illustrated embodiment, there are three locking balls peripherally spaced around the second extension 22 and positioned within an associated radially extending passage 52.

The lower end of the second extension 22 is also provided with an axial passage 53 sized to receive an actuator or operator ball 54 which is movable along the extension 22 for extending and retracting the locking balls 51. When the actuating ball 54 is moved downwardly along the passage 53, it causes the three locking balls 51 to move radially outward to the locking position illustrated in FIG. 4. When the actuating ball 54 is allowed to move upwardly from the illustrated position, the locking balls 51 are free to move radially inward to their released position.

Positioned above the actuating ball 54 is an actuator pin 56 which is movable along the central axis 25 within an axial bore 57. Above the actuator pin 56 is a bolt 58 threaded into a threaded portion 59 of the passage 67 and engageable with the upper end of the actuating pin 56. The bolt 58 is provided with a head 61 engageable with the upper surface 62 of the first extension 23 when the locking balls 51 are in their extended position. The head 61 may be provided with a socket or a hexagonal outer shape so that the bolt 58 can be threaded in and out along the first extension 23.

A conventional O-ring 63 is positioned within a groove 64 formed adjacent to one side of the passages 52 and is sized and positioned so that it normally maintains the locking balls in their respective passages when the load assembly is removed from the load 11 even when the bolt 58 is threaded in until its head 61 engages the surface 62.

FIGS. 7 through 10 illustrate a second embodiment of a load lock system for locking a load ring on a load. This embodiment is preferred for very high load conditions and provides area contact between the various locking elements so that they will not fracture under very high loading conditions.

In this embodiment, a mounting member 117 is again provided with a flange 118 and first and second generally cylindrical extensions 121 and 122 extending in opposite directions from the flange 118. In this embodiment, the extension 121 is identical in shape to the extension 21 of the embodiment of FIG. 2, and is adapted to support a swivel collar 26 and load ring 16 in the same manner as the embodiment of FIG. 2. However, for purposes of simplifying the drawings, such members are not illustrated installed on the cylindrical extension 121.

There are three peripherally spaced locking elements 151 positioned in radially extending passages 152 which are again radially movable between a retracted position for release of the load ring assembly and an extended position in which they engage a conical wall 147 to lock the load ring assembly in the load 111. The passages 152 are circular in cross section, and the locking elements are generally cylindrical and sized to closely fit the associated passages.

The bushing 136 is identical to the bushing 36 of the first embodiment, and provides the conical wall 147. The locking elements are formed with locking surfaces 150 which are portions of a cone shaped to engage and mate with adjacent portions of the conical wall 147.

The actuator pin 156 is formed with a conical end 155 and is again extended and allowed to retract by a bolt 158. The locking elements are formed with operating surfaces 160 shaped to mate with the conical end 155.

The various elements are preferably sized and shaped so that when the unit is installed and locked, the conical locking surfaces 150 mate with and provide substantial area contact with the conical wall 147, and the conical end 155 of the actuator pin also mates with and provides substantial area contact with the operating surfaces 160 on the locking element. Such full area contact prevents the occurrence of any concentrated loads on the elements of the load ring and permits them to withstand very high loads without failure.

In some instances, full mating contact may not occur and large area contact may not be present. For example, if the spacing between the surface of the load 111 and the conical wall 147 results in the location of the locking surfaces 150 either above or below the exact position in which full mating contact can occur, the contact of the ends of the locking pins 151 with the bushing 136 and the actuator pin will not provide full mating contact. However, in such instances, the contact area is not point contact and high loads can be supported without failure.

A wire ring spring 163 is positioned within a groove 164 in the cylindrical extension 122 to retain the locking elements in their assembled position when the load ring is removed from the load. In this embodiment, however, the spring also extends along a mating groove 165 formed in the outer ends of the locking elements which is in alignment with a cylindrical portion 148 in the mounting bushing 136. Therefore, the groove 165 is formed with a sufficient cross section to completely enclose the spring 163 so that it is not compressed when the locking elements extend into locking engagement with the bushing. In this embodiment, the spring also maintains the locking elements 151 in their proper rotational orientation.

The inner ends of the locking elements are formed with wedge-shaped end surfaces 170 so that they can be moved inwardly to a fully retracted position by the spring 163.

Two embodiments for securing the load ring 16 to the pivot collar 26 are illustrated. In the first embodiment, the load ring 16 is generally U-shaped, providing legs 66 and 67 which extend down along the outer sides of the pivot ring 26, and are secured thereto by a pivot structure including a pair of rivets 68 and 69, respectively. Such rivets extend through passages 71 in the associated legs 66 and 67, and along opposed radial passages 72 formed in the pivot collar 26. Roll pins 73 lock the rivets 68 and 69 in the collar. Therefore, the load ring 16 is connected to the swivel or pivot collar 26 for pivotal movement relative thereto around a second axis 74 contained in a plane perpendicular to the axis 25. Thus, a structure is provided in which full swiveling of the load ring is permitted and the load ring automatically moves to a position in alignment with the force applied thereto.

FIGS. 5 and 6 illustrate a modified load ring and pivot mounting structure which may be used when increased strength is required. In this embodiment, similar reference numerals are used to designate parts corresponding to the first embodiment, but a prime (') is added to indicate reference to the second embodiment.

Here again, the mounting member 17' is provided with a cylindrical portion 23' around which a pivot collar 26' extends and is journaled for rotation about the pivot axis 25'. Also, the pivot collar 26' is axially positioned between a nut 29' and the upper surface of a shoulder 18'. In this embodiment, however, the load ring 16' is provided with inwardly extending, integral pivot projections 81' which extend into downwardly open pivot passages 82' formed in the pivot collar 26'.

As best illustrated in FIG. 6, these pivot passages 82' are provided with a semicylindrical upper surface sized to closely fit the pivot extensions 81' and are downwardly open to the lower face 27' of the swivel ring. With this structure, the integral pivot extensions 81' are assembled with the pivot ring 26' prior to positioning the pivot ring 26' on the extension 23' and the locking of the pivot ring in position by the nuts 29'. This embodiment provides greater strength for the mounting of the load ring, and is preferred when greater strength is required.

Figure 7:
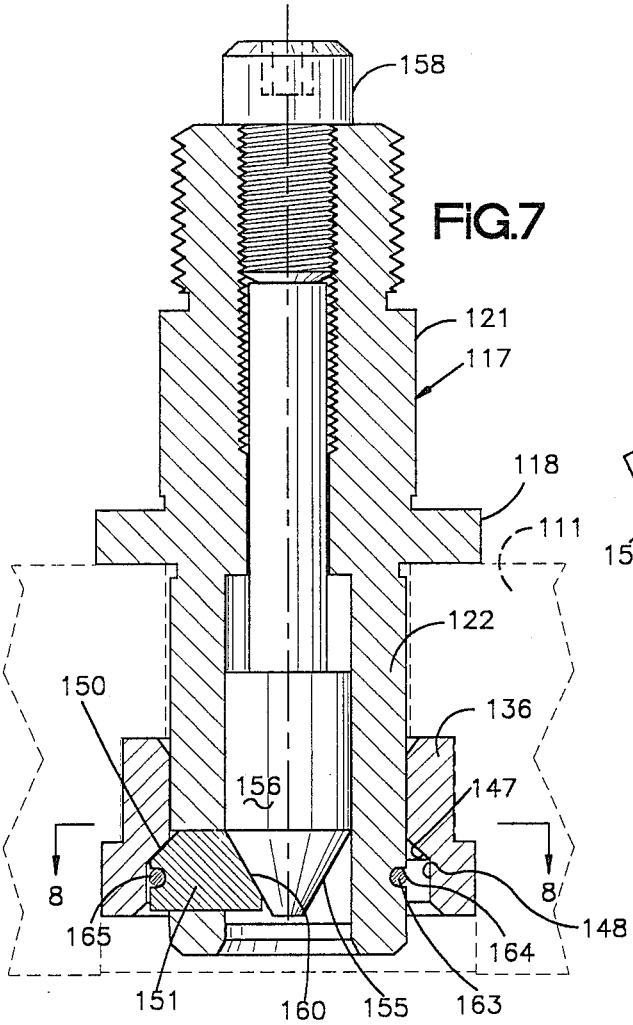
FIG. 7 is a fragmentary, longitudinal section illustrating a second embodiment lock structure capable of supporting higher loads.
Figure 8:
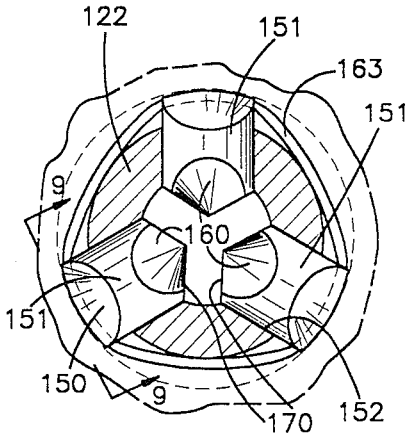
FIG. 8 is a fragmentary cross section taken along line 8—8 of FIG. 7, with the central operating pin removed for purposes of illustration.
Figure 10:
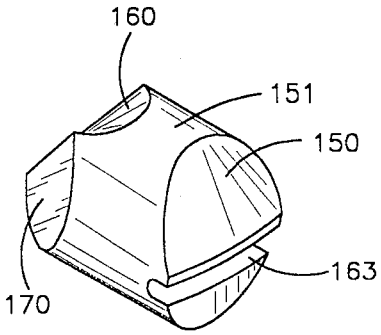
FIG. 10 is a perspective view of one of the lock elements of the embodiment of FIGS. 7 through 9.
Figure 9:
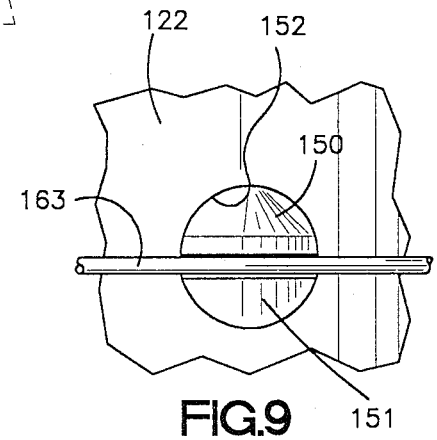
FIG. 9 is an enlarged, fragmentary section taken generally along line 9—9 of FIG. 8.

In both embodiments, it is a simple matter to remove or install the load ring assembly within a load 11 or 111. Assuming that the load ring is already installed, it is removed by merely threading the bolt 58 or 158 upwardly with respect to the mounting member to allow the actuator rod 56 or 156 to move upwardly along the bore 57. After the bolt 58 or 158 is threaded back, an upward force on the load ring causes the locking balls 51 or locking elements 151 to be cammed inwardly by their engagement with the conical surface 47 or 147. This, in turn, raises the actuator 54 or 156. When the locking balls 51 or elements 151 are moved radially inward by this camming action until they do not project beyond the outer surface of the second extension 22 or 122, the entire assembly is merely raised up out of the bushing and out of the load. In such condition, the O-ring 63 or 163 retains the locking balls 51 or elements 151 in their assembled position regardless of the orientation of the load ring assembly 10. In the embodiment of FIGS. 7 and 8, the O-ring automatically retracts the locking elements as the bolt is threaded back to release the lock ring.

When it is desired to reinstall the load ring in the load 11, the lower or second extension 22 or 122 is merely pressed down along the passage leading to the bushing. If at such time the locking balls 51 extend outwardly beyond the sides of the lower extension 22, they are cammed inwardly to allow such insertion.

Insertion of the second extension 22 or 122 continues until the lower face of the flange 18 or 118 engages the upper surface of the load 11 or 111 to prevent further insertion, and to position the locking elements within the bushing for proper locking. The bolt 58 or 158 is then threaded inwardly along the threaded portion 59 of the passage 57 until the head 61 thereof is seated against the end surface 62. This inward movement of the bolt extends the actuator pin 56 or 156, causing radial extension of the three locking elements in a uniform manner. The various elements are preferably sized so that in the fully extended position of the locking elements, they bear against the conical surface 47 or 147 and axially press the flange against the upper surface of the load. This ensures that the load ring assembly 10 is firmly seated in the load and is properly supported.

Because an intermediate bearing or bushing is not required between the pivot collar and the upper extension 21, the two extensions 21 and 22 of the mounting member can be provided with a diameter substantially equal to the spacing between the rivets 68 and 69 or the pivot extensions 81'. Therefore, a mounting member of maximum strength is provided. Further, since the opening in which the load ring assembly 10 is mounted is devoid of threads or other groovelike structure, debris which may exist in the opening in the load and in the bushing does not significantly inhibit the installation of the assembly. Finally, because the locking elements 51 or 151 are positively maintained in their extended position by the bolt 58 or 158, there is no tendency for the load ring to become dislodged even when substantial loads are applied thereto.

With this invention, a simple, high strength load ring mounting system is provided with a full swivel, and which can be easily installed or removed from a load as desired.

Although the preferred embodiments of this invention have been shown and described, it should be understood that various modifications and rearrangements of the parts may be resorted to without departing from the scope of the invention as disclosed and claimed herein.

What is claimed is:

1. A load ring and load combination comprising a load, a receptacle in said load providing an opening accessible from one surface of said load, said opening providing a first cylindrical portion and a conical portion inclined radially away from the end of said cylindrical portion remote from said one surface, load connecting means providing a one-piece elongated mounting member having a central flange engaging said one surface and a first cylindrical end extending through said cylindrical portion with a close fit and beyond said cylindrical portion into radial alignment with said conical portion, the other end of said mounting member providing a second cylindrical end projecting from said central flange beyond said load surface, a pivot collar journaled on said second cylindrical end of said mounting member for rotation relative thereto about a first axis aligned with the length of said mounting member and locked against movement relative to said second cylindrical end along said first axis, a generally U-shaped load ring journaled on said pivot collar for pivotal movement relative thereto about a second axis contained in a plane substantially perpendicular to said first axis, a plurality of locking elements mounted on said first cylindrical end and fadially movable relative thereto between an extended locking position in which they engage said conical portion to lock said mounting member in said receptacle with said flange against said one surface and a retracted position in which they permit said mounting member to be removed from said receptacle, and a threaded fastener accessible from said other end of said mounting member threaded into said other end of said mounting member providing a positive mechanical system for locking said locking elements in said extended position, said threaded fastener operating when threaded axially of said mounting member to a release position to allow retraction of said locking elements for removal of said mounting member from said receptacle.

2. A combination as set forth in claim 1, wherein a centrally located operating element is axially movable within said one end of said mounting member by said threaded fastener and provides an operative connection between said threaded fastener and each of said locking elements.

3. A combination as set forth in claim 2, wherein retainer means operate to retain said locking elements in said one end when said mounting member is removed from said receptacle.

4. A combination as set forth in claim 3, wherein said threaded fastener provides a head engageable with said other end of said mounting member to prevent extension of said locking elements a sufficient distance to cause said retainer means to fail to retain said locking elements in said mounting member.

5. A combination as set forth in claim 4, wherein an operating rod is interposed between said threaded fastener and said operating element and which is axially movable in said mounting member to position said operating element in response to the position of said threaded fastener.

6. A combination as set forth in claim 5, wherein said operating element and said locking elements are spherical.

7. A combination as set forth in claim 2, wherein said locking elements provide conical end surfaces to minimize concentrated loads from being applied.

8. A combination as set forth in claim 7, wherein said locking elements are generally cylindrical and closely fit mating passages in said one end to provide area contact therebetween.

9. A combination as set forth in claim 8, wherein a spring extends around said locking elements biasing them toward said retracted position and maintaining correct rotational orientation thereof.

10. A combination as set forth in claim 1, wherein said load ring provides integral inwardly extending opposed pivots which pivotally connect said load ring to said pivot collar.

11. A combination as set forth in claim 10, wherein said inwardly extending opposed pivots are spaced apart a distance substantially equal to the diameter of said other end of said mounting member.

12. A load ring assembly for releasably mounting a load ring on a load, comprising a one-piece elongated mounting member providing a flange intermediate its ends, first and second cylindrical extensions extending from opposite sides of said flange to ends, a pivot collar journaled on said first extension on one side of said flange for rotatable movement about a first axis, means on the side of said pivot collar remote from said flange locking said collar against axial movement relative to said first extension in a direction away from said flange, a load ring pivotally mounted on said pivot collar for pivotal movement relative thereto about a second axis contained in a plane substantially perpendicular to said first axis, a plurality of locking elements mounted in said second extension for radial movement between a retracted position and an extended position, said locking elements in said extended position being operable to lock said second extension in a mating receptacle in a load, movement of said locking elements to said retracted position operating to release said mating receptacle, and operating means accessible from said end of said first extension for moving said locking elements between said retracted and said extended positions.

13. A load ring assembly as set forth in claim 12, wherein said operating means is a threaded fastener threaded into said first extension to provide a positive mechanical system for maintaining said locking elements in said extended position when said second extension is located in said receptacle.

14. A load ring assembly as set forth in claim 13, wherein said locking elements are spherical and a spherical operating element is located in said second extension to operate said locking elements in response to movement of said threaded fastener.

15. A load ring assembly as set forth in claim 13, wherein said locking elements provide generally conical end surfaces which provide locking contact of sufficient area with said mating receptacle and with said operating means to prevent excessive concentrated loads from being applied to said locking elements.

16. A load ring assembly for releasably mounting a load ring on a load comprising an elongated mounting member, a load ring pivotally mounted on one end of said mounting member for pivotal movement relative thereto, the other end of said mounting member being cylindrical and providing a plurality of peripherally spaced radial passages having a circular cross section, a plurality of similar cylindrical locking elements, one of which is mounted in each of said passages with a close fit providing substantial area contact with the associated of said passages, a mating receptacle providing a conical locking surface, said other end being sized to fit into said receptacle with a close fit to a mounted position in which said locking elements are aligned with said conical locking surface, said locking elements providing conical end surfaces proportioned for mating engagement with said conical locking surface when said locking elements are in an extended position, and operating means providing an operating element having a conical end engaging said locking elements with area contact and operable to move said locking elements between said extended position and a retracted position, and an O-ring positioned around said locking elements biasing said locking elements toward said retracted position and maintaining proper rotational orientation of said locking elements.

17. A quick-release mounting device for mounting on a structure having opening means providing a cylindrical surface extending from an open end to an inner end, and a diverging conical surface extending from said inner end, said mounting device comprising a mounting member providing a cylindrical portion sized to closely fit said cylindrical surface and a shoulder at one end of said cylindrical portion engageable with said structure around said opening means to locate said mounting member in a predetermined position within said opening means when said cylindrical portion is inserted into said opening means, said mounting member providing a plurality of peripherally spaced radially extending cylindrical passages aligned with said conical surface when said mounting member is in said predetermined position, a cylindrical locking member positioned in and closely fitting each of said cylindrical passages, said locking members being radially movable within the associated of said cylindrical passages between a locking position and a retracted position, said locking elements being formed with outer ends providing a surface which is a portion of a cone shaped to engage and mate with said conical surface when said mounting member is in said predetermined position and said locking members are in said locking positions, said mounting member providing an axial passage open to said radial passages, an actuator member movable along said axial passage providing operating surface means engageable with the inner ends of said locking members, said actuator member being movable along said axial passage between an operated position and a released position, movement of said actuator member from said released position to said operated position causing said locking members to move to said locking position, said operating surface means of said actuator member and said inner ends of said locking members providing mating surfaces which engage with substantial area contact when said actuator member is in said operated position, and resilient means operating to retract said locking members to said retracted position when said actuator member moves to said released position and to also maintain a predetermined orientation of said locking members within their associated radial passages, said conical surface and said cone-shaped ends of said locking members providing substantial area of engagement when said locking members are in said locking position.

18. A quick-release mounting device as set forth in claim 17, wherein said operating surface means and said inner ends of said locking means each provide mating surfaces which engage with substantial area contact and which are surfaces of revolution around the axis of said cylindrical portion.

19. A quick-release mounting device as set forth in claim 18, wherein said surfaces of revolution are conical.

* * * * *